US006115938A

United States Patent [19]

Oechsle

[11] Patent Number: 6,115,938

[45] Date of Patent: Sep. 12, 2000

[54] MACHINE FOR PRODUCING A MATERIAL WEB

[75] Inventor: Markus Oechsle, Bartholomae, Germany

[73] Assignee: Voith Sulzer Papiermaschinen GmbH, Heidenheim, Germany

[21] Appl. No.: 08/914,798

[22] Filed: Aug. 20, 1997

[30] Foreign Application Priority Data

Aug. 29, 1996 [DE] Germany ..... 196 34 914

[51] Int. Cl.[7] ..... F26B 11/02

[52] U.S. Cl. ..... 34/114; 34/116; 34/117; 34/120

[58] Field of Search ..... 34/114, 115, 116, 34/117, 120, 122, 123; 162/193, 207, 363, 364, 365, 366, 367, 368, 369

[56] References Cited

U.S. PATENT DOCUMENTS

| | | | |
|---|---|---|---|
| 4,669,198 | 6/1987 | Wedel | 34/456 |
| 4,821,429 | 4/1989 | Sieberth | 34/114 |
| 4,893,741 | 1/1990 | Heinzmann | 242/615 |
| 5,033,207 | 7/1991 | Sturm et al. | 34/115 |
| 5,086,571 | 2/1992 | Hietanen | 34/117 |
| 5,115,581 | 5/1992 | Viitanen | 34/115 |
| 5,341,579 | 8/1994 | Schiel et al. | 34/115 |
| 5,515,619 | 5/1996 | Kahl et al. | 34/114 |

FOREIGN PATENT DOCUMENTS

| | | |
|---|---|---|
| 0415460 | 3/1991 | European Pat. Off. . |
| 0447385 | 9/1991 | European Pat. Off. . |
| 3538623 | 5/1986 | Germany . |
| 3739338 | 6/1989 | Germany . |
| 3836751 | 6/1989 | Germany . |
| 3922361 | 1/1991 | Germany . |
| 4141296 | 6/1993 | Germany . |

*Primary Examiner*—Pamela A. Wilson
*Attorney, Agent, or Firm*—Greenblum & Bernstein, P.L.C.

[57] ABSTRACT

A machine for producing a material web, including a paper or cardboard web, having a plurality of cylinders around which the material web is guided in a meandering path together with a conveyor (transport) belt. The machine further includes at least one air conveying device disposed in the transfer region between two cylinders. The air conveying device associates with the free circumference region of a cylinder and aspirates the material web as the material web travels in a path free from contact with the cylinders as the material web travels between two succeeding cylinders. The material web and the conveyor belt are partially wound around the circumference region of the cylinders. According to the invention, the air conveying device only covers certain areas of the free circumference region of the cylinder on which the material web (paper web) winds.

41 Claims, 2 Drawing Sheets

MACHINE FOR PRODUCING A MATERIAL WEB

CROSS-REFERENCE TO RELATED APPLICATION

The present application claims priority under 35 U.S.C. §119 of German Patent Application No. 196 34 914.1 filed Aug. 29, 1996, the disclosure of which is expressly incorporated by reference herein in its entirety.

BACKGROUND OF THE INVENTION

1. Field of the Invention

The invention relates to a machine for producing a material web, particularly, a paper or cardboard web.

2. Background of the Invention

Machines of the type mentioned here are generally known. The known machines contain a plurality of cylinders around which a material web, together with a conveyor belt, are guided in a meandering path. In the transfer region between two cylinders, the material web and the conveyor belt are associated with an air conveying device that is intended to prevent or reduce the wobbling of the material web. The air conveying device has relatively large structural tolerances. However, this increases the cost of the device and increases the structural length of the machine. Moreover, assembly of the air conveying device and access to the device has proved complicated due to the position of the air conveying device inside the machine.

Accordingly, the object of the present invention is to create a machine for producing a material web that overcomes the above-mentioned disadvantages.

SUMMARY OF THE INVENTION

To overcome the above-noted defects and disadvantages, a machine is proposed that includes a plurality of cylinders around which a paper web, together with a conveyor (transport) belt, are guided. The paper web rests against the outer surface of the cylinders. The machine further includes an air conveying device disposed in the transfer region between two cylinders. The air conveying device is used for the reliable transfer of the paper web.

The air conveying device is embodied so that it covers only certain areas of the free circumference region of the cylinder onto which the material web winds, thus, the size of the air conveying device is reduced.

The size of the free circumference region that is not encircled by either the material web or the conveyor belt, i.e. its arc length, is a function of the positioning of the preceding and subsequent cylinder, when viewed in terms of the machine's running direction. Because the air conveying device extends only over a partial region of the free circumference region, or covers this circumference region, the accessibility of the air conveying device inside the machine is improved. Accordingly, it is more feasible to assemble the air conveying device and to perform maintenance work. Furthermore, because the air conveying device is narrow and enables the space between the cylinders to be reduced, it is possible to reduce the length of the machine for producing the material web.

One preferred embodiment of the machine includes a cover that spans the remaining free circumference region. The cylinder that is associated with the air conveying device has perforations or recesses on its outer surface and is connected to a vacuum device. The cover shields the suction region in relation to the environment and thus reduces the secondary air volume taken in by the aspirated cylinder. Accordingly, the power necessary to generate a vacuum by the vacuum device connected to the cylinder can be relatively low. The reduced power consumption of the vacuum device reduces the operating costs of the machine.

In another aspect of the machine, the air conveying device has a multi-part housing. Preferably, the first housing part of the air conveying device may be subjected to an overpressure. The second housing part has a wall that is adapted to the outer surface of the cylinder and is essentially concave.

According to another aspect of the invention, it is preferable to have the housing parts associated with one another such that a gap is formed between them. Air is withdrawn from the transfer region through this gap. Viewed in terms of the flow direction of the air, the gap preferably has a diverging course that leads to an intensified nozzle effect, i.e. the air blast that emerges from the first housing part and that is conveyed into the gap produces a vacuum inside the gap, which aspirates the air disposed in the transfer region and thus assures a reliable transfer of the material web in the region between the cylinders where the conveyor belt and the paper web travel in a path free from contact with the cylinders.

Another way of expressing the present invention is a machine for producing a material web, including a paper web or a cardboard web, comprising a plurality of cylinders wherein at least one of the cylinders includes a free circumference region and a circumference region. The machine further includes a conveyor belt, wherein the conveyor belt and the material web are guided in a meandering path around the plurality of cylinders. The conveyor belt and the material web wind around the circumference region of at least one of the cylinders. The machine further includes at least one air conveying device disposed in the transfer region between two of the cylinders. The transfer region is where the conveyor belt and the material web travel in a path free from contact with the cylinders. At least one of the air conveying devices associates with the free circumference region and aspirates the material web in the transfer region. Further, at least one of the air conveying devices partially covers the free circumference region of the cylinder on which the material web is wound.

According to another aspect of the present invention, at least one of the air conveying devices covers 30% to 70% of the free circumference region.

According to another aspect of the invention, at least one of the air conveying devices covers 35% to 60% of the free circumference region.

In accordance with another embodiment of the invention, at least on of the air conveying devices covers 55% of the free circumference region.

In accordance with one embodiment of the invention, the air conveying devices further includes a cover covering the remainder of the free circumference region. The cover can moreover, be disposed on an outer surface of at least one of the plurality of cylinders or the cover may be disposed on the inside of at least one of the cylinders. Further, the cover may be disposed on an outer surface of at least one of the cylinders and on the inside of at least one of the cylinders.

In accordance with one embodiment of the invention, the air conveying device may include a multi-part housing. The multi-part housing may includes a first housing part, which is acted upon by a vacuum. The multi-part housing may further include a second housing part of the air conveying device that includes a wall contoured and adapted to an outer surface of at least one of the cylinders, wherein the second housing part covers a portion of the free circumference region of at least one of the cylinders. The first and second housing parts may form a gap wherein air is withdrawn through the gap from the transfer region. The gap may diverge, when viewed laterally from the flow direction.

In accordance with another aspect of the machine, machine may include, as the air conveying device, a suction box. The suction box may further include a wall that includes openings leading to the interior of the suction box whereby a vacuum can be exerted on a jacket surface of at least one of the cylinders. The suction box may further include a cover covering the free circumference region of at least one of the cylinders.

Another way of expressing the present invention is a machine for producing a material web, comprising a plurality of cylinders wherein at least one of the plurality of cylinders includes a free circumference region and a circumference region. The machine further includes a transport belt, wherein the transport belt and the material web are guided in a meandering path around the plurality of cylinders and wherein the transport belt and the material web wind around the circumference region of at least one of the plurality of cylinders. The machine further includes a transfer region between two of the plurality of cylinders wherein the transport belt and the material web travel in a path free from contact with the plurality of cylinders. The machine further includes at least one air conveying device disposed in the transfer region between two of the plurality of cylinders, wherein at least one of the air conveying devices associates with the free circumference region and aspirates the material web in the transfer region.

According to another aspect of the invention, the machine can produce either a paper web or a cardboard web.

In accordance with another aspect of the invention, at least one of the air conveying devices partially covers the free circumference region of at least one of the plurality of cylinders on which the material web is wound.

In accordance with one embodiment of the invention, at least one of the air conveying devices covers 30% to 70% of the free circumference region.

In yet another aspect of the invention, at least one of the air conveying devices includes a cover covering the remainder of the free circumference region wherein the cover is disposed on an outer surface of at least one of the plurality of cylinders. At least one of the air conveying devices further includes a multi-part housing, including a first housing part and a second housing part wherein the first housing part is acted upon by a vacuum.

In accordance with another aspect of the invention, the first housing part includes an air blast source and a conduit-like supply line disposed on the inside, wherein the air blast source connects to the conduit-like supply line. The first housing part further includes a limit wall including a through opening, wherein air disposed on the inside of the first housing part emerges through the through opening.

In one aspect of the invention, the second housing part further includes a wall contoured and adapted to an outer surface of at least one of the cylinders, wherein the second housing part covers a portion of the free circumference region of at least one of the cylinders.

In accordance with one aspect of the invention, the first and second housing parts form a gap wherein air is withdrawn through the gap from the transfer region and wherein the gap diverges when viewed laterally from the flow direction.

Other useful embodiments and advantages of the present invention may be ascertained by reviewing the present disclosure and the accompanying drawings.

BRIEF DESCRIPTION OF THE DRAWINGS

The invention will be better understood by referring to the description which follows with reference to the drawings, which illustrate by way of non-limiting examples, embodiments of the invention, with like reference numbers representing similar parts throughout the several views, and wherein.

DETAILED DESCRIPTION OF THE DRAWINGS

Figure 1:
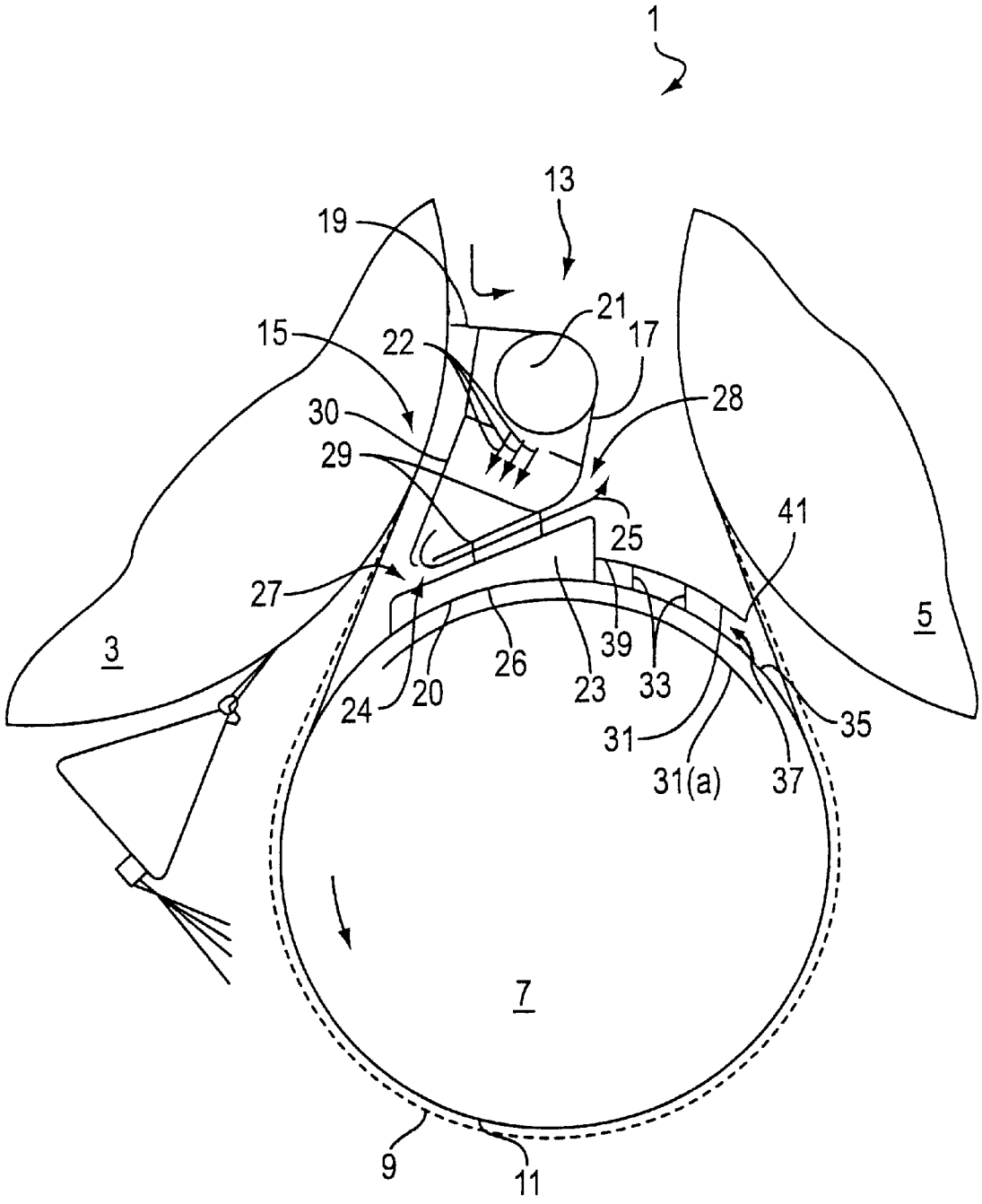
FIG. 1 is a schematic diagram of an embodiment of an air conveying device disposed in a transfer region part to be used in a machine producing a material web.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

The machine described below can be generally used for producing a continuous material web. Purely by way of example, it is assumed below that it is a machine for producing a paper web, i.e., a paper making machine.

FIG. 1 shows a detail of a paper making machine 1 that contains a plurality of cylinders of which only the cylinders 3, 5 and 7 are shown here. The cylinders 3 and 5 can, for example, be drying cylinders of a dryer section. A paper web 9 is guided around the cylinders 3, 5 and 7, together with a conveyor belt 11.

In accordance with another aspect of the invention, the conveyor (transport) belt 11 may also be described as a dryer screen, a felt belt, or a support belt. The paper web 9 rests against the outer surface of cylinders 3 and 5. The cylinder 7, which is disposed between the cylinders 3 and 5, is staggered downward from cylinders 3 and 5 in the vertical direction. The cylinder 7 in this embodiment is a guide roll which can be acted on with vacuum and around which the paper web 9 is guided while resting against the outside of the guide roll. In another preferred embodiment, the cylinder 7 may also be a drying cylinder. According to another embodiment of the present invention, it is possible for cylinder 3 and/or cylinder 5 to be a guide roll that can be aspirated if necessary.

An air conveying device 13 is disposed in the transfer region between the cylinder 3 and the cylinder 7 and is used for the reliable transfer of the paper web 9. In the present embodiment, the air conveying device 13 has a multi-part housing 15. An air stripping blade 19 is disposed on a first housing part 17 of the air conveying device 13 and can be comprised of a felt strip or a plastic brush. The air stripping blade 19 is used to strip the boundary layer of air trapped by the conveyor belt 11.

In accordance with yet another aspect of the invention, instead of the air stripping blade 19, an air doctor/blade can also be provided. The air doctor/blade strips the air layer trapped by the conveyor belt 11 by using an air stream blast directed at the conveyor belt 11.

A conduit-like supply line 21 is disposed on the inside of the first housing part 17. In the present embodiment, the conduit-like supply line 21 is connected to an air blast source, which is not shown in FIG. 1.

The air flow emerging from the conduit-like supply line 21 is indicated by arrows 22. A through opening 24 is located on the limit wall of the first housing part 17, from which through opening 24 the pressurized air disposed on the inside of the first housing part 17 can emerge.

In accordance with another aspect of the invention, a second housing part 23 of the air conveying device 13 is disposed on the outer surface of the cylinder 7. The second housing part 23 partially covers the free circumference region of the cylinder 7. The free circumference region of the cylinder 7 is the part of the circumference surface of the cylinder 7 that the paper web 9 or the conveyor belt 11 does not wind around or encircle.

The wall 26 of the second housing part 23, which is oriented toward the outer surface of cylinder 7, is contoured to substantially adapt to the outer surface of the cylinder 7. Thus, the intermediary space 20 which is formed between the wall 26 and the outer surface of the cylinder 7 is relatively even and can be small. In the preferred embodiment shown in FIG. 1, the cylinder 7 is an aspirated guide roll and has recesses, for example bores, which are not shown in FIG. 1, distributed about the circumference of the guide roll. The recesses penetrate the wall 26 and provide a connection from the outer surface of the cylinder 7 to the inner chamber of the second housing part 23. It is also possible to have grooves disposed on the outer surface of the cylinder 7.

The cylinder 7 is preferably connected to a vacuum source, not shown in FIG. 1, by a bearing pin, also not shown in FIG. 1, disposed on its end face. Starting from the inner chamber, the vacuum extends, via the recesses, until it reaches the outer surface of the cylinder 7. Thus, the paper web and the porous conveyor belt are drawn taut and stabilized primarily in the wound or circled circumference region. Thus, lifting and wobbling of the paper web 9 is prevented while the paper web 9 travels around the cylinder 7. The vacuum can also be exerted on the jacket of the cylinder 7 from the outside, for example by the air conveying device 13 or by the second housing part 23, which is connected to a vacuum source for this purpose.

As shown in FIG. 1, the effective region of the vacuum may extend into the winding and unwinding regions of the cylinder 7. To provide an area in the transfer region that is sealed off from the environment of the paper making machine, the transfer region is preferably sealed on both end faces of the machine, viewed in terms of the running direction of the machine, i.e. on the guiding side and on the driving side. The wall 26 of the second housing part 23 partially covers the free circumference region of the cylinder 7, thus reducing the secondary air intake, i.e. the secondary air aspirated. The air conveying device 13 in this particular embodiment further includes a wall 26 of the second housing part 23 which may cover between 30% and 70% of the free circumference region of the cylinder 7. In another embodiment of the present invention, the wall 26 may cover 35% to 60% of the free circumference region of the cylinder 7. Preferably, the wall 26 of the second housing part 23 covers approximately 55% of the free circumference region of the cylinder 7.

The two housing parts 17 and 23 are spaced apart, forming a gap 28 through which the air that is located in the region of the winding gap 27 between the cylinder 7 and the transfer region from the cylinder 3 to the cylinder 7 is withdrawn. Thus, the paper web 9 is stabilized in the region where the paper web and the conveyor belt 11 travel in a path free from contact with cylinders 3 and 7 and the paper web 9 is prevented from wobbling. This practically eliminates accidental tearing of the paper web.

In another aspect of the invention, the housing parts 17 and 23 of the air conveying device 13 are connected to each other by rib-like spacers 29, examples of which are shown in FIG. 1. The size and course of the gap 28 can be adjusted by varying the length of the spacers 29. In one embodiment, the gap 28 opens in the flow direction, as shown by arrow 25. The withdrawal of air from the winding gap 27 of the cylinder 7, as well as from the transfer region between cylinders 3 and 7, is accomplished by generating a vacuum in the gap 28. To this end, the air blast 22 emerging from the through opening 24 of the first housing part 23 is deflected or conveyed into the gap 28 and flows out of the air conveying device 13 in the direction shown by arrow 25. Inside the gap 28, a vacuum is formed, causing the air trapped in the transfer region and the winding region 27 to be aspirated. As a result, air does not become trapped between the conveyor belt 11 or the paper web 9 and the cylinder 7. Air between the conveyor belt 11 or the paper web 9 and the cylinder 7 can lead to a lifting of the paper web. Thus, with the elimination of the air, the free travel of the paper web 9 and the conveyor belt 11 between the cylinder 3 and the cylinder 7 is stabilized.

In accordance with another aspect of the invention, it is possible to connect the supply line 21, which is disposed in the first housing part 17, to a vacuum source and to make the limit wall 30 of the air conveying device at least partially air permeable. The limit wall 30 is oriented toward the transfer region. As a result, air can be withdrawn directly from the transfer region of the paper making machine.

As shown in FIG. 1, a cover 31 adjoins the second housing part 23 of the air conveying device 13 and covers the remaining free circumference region of the cylinder 7 that is not covered by the air conveying device 13. As a result, practically all of the free circumference region of the cylinder 7 is covered, thereby minimizing the secondary air quantity aspirated and enabling the reduction in the power of the vacuum source attached to the cylinder 7. Thus, the cover 31 covers the recesses or perforations of the cylinder 7, through which the vacuum is exerted on its outer/jacket surface. In accordance with the present invention, preferably, a cover 31(*a*) is provided within the inner chamber of the cylinder 7 which completely or partially covers the recesses in the cylinder wall in the region of the free circumference region. The cover 31(*a*) inside the cylinder 7 can be provided in addition to or instead of the cover 31 and/or the wall 26 of the second housing part 23 of the air conveying device 13.

The cover 31 preferably comprises an airtight material and is manufactured to extend over the entire width of the machine when the machine is viewed laterally in view of the running direction of the machine. As can be seen in FIG. 1, braces 33 position the cover 31 so that a gap 37 is formed between the cover 31 and the jacket surface 35 of the cylinder 7. The braces 33 are affixed to the guiding side of the machine for producing the paper web 9. Other braces, not visible in this sectional view of FIG. 1, which hold the cover 31, are disposed on the driving side of the machine. Here, the cover 31 has an arc-shaped contour that is adapted to the contour of the jacket surface 35 of the cylinder 7 so that an even gap 37 is formed. In the embodiment shown in FIG. 1, the left end 39 of the cover 31 touches or directly adjoins the second housing part 23 of the air conveying device 13. The right end 41 of the cover 31 extends substantially directly to the conveyor belt 11 as the conveyor belt 11 unwinds from the cylinder 7, but their is no contact between the conveyor belt 11 and the cover 31.

In accordance with another aspect of the invention, a sealing strip can be provided at the right end 41 of the cover 31. The sealing strip would achieve a complete sealing of the free circumference region of the cylinder 7 and would rest against the conveyor belt 11 or touch the conveyor belt 11. Alternatively, the right end 41 could be designed so that the right end 41 includes the sealing strip. This embodiment is not shown in FIG. 1.

In accordance with one aspect of the invention, the cover 31 can be constructed as one piece. Preferably, however, the cover 31 is constructed of a number of parts or segments that are connected to each other.

A further possibility for reducing the secondary air aspirated in the free circumference region of the cylinder 7 is to reduce the cross-sectional surface area of the recesses disposed in the jacket of the cylinder 7 so that the vacuum acting on the outer surface of the cylinder just great enough to prevent a lifting of the paper web and the conveyor belt. This measure may make it possible to eliminate the cover 31, and other covers disposed on the inside of the cylinder 7, without increasing the quantity of the aspirated secondary air.

As can be seen from FIG. 1, the length of the air conveying device 13, viewed in terms of the running direction of the machine, is smaller than the narrow spacing between the cylinders 3 and 5. When assembling the air conveying device 13 or when carrying out maintenance procedures, the air conveying device 13 can be easily removed from the machine in an upward direction. Furthermore, the compact air conveying device 13 makes it possible to reduce the spacing between the cylinders 3 and 5 and, thus, the length of the paper making machine.

The multi-part housing 15 of the air conveying device 13 provides other advantages as well. The first housing part 17 is a universally usable base body that can be used in practically any transfer region between two cylinders inside the paper making machine. Moreover, the second housing part 23 is adaptable to a variety of conditions, depending on where it is used. For example, the second housing part 23 can be adapted to the diameter of the cylinder associated with the air conveying device and/or to the free circumference region to be covered. Consequently, many variants of the air conveying device 13 can be significantly reduced, which reduces the manufacture costs and reduces the storage costs or outlay.

Another embodiment of the air conveying device 13 is described with reference to FIG. 2. In this embodiment, the air conveying device 13 includes a suction box 43, which is disposed in the transfer region between a cylinder 3 and a cylinder 7. The following description uses the same reference numbers for elements that coincide with those discussed with respect to FIG. 1 and the common description is only briefly discussed. The differences with respect to the air conveying device illustrated in FIG. 2, with respect to FIG. 1, are discussed in detail.

Figure 2:
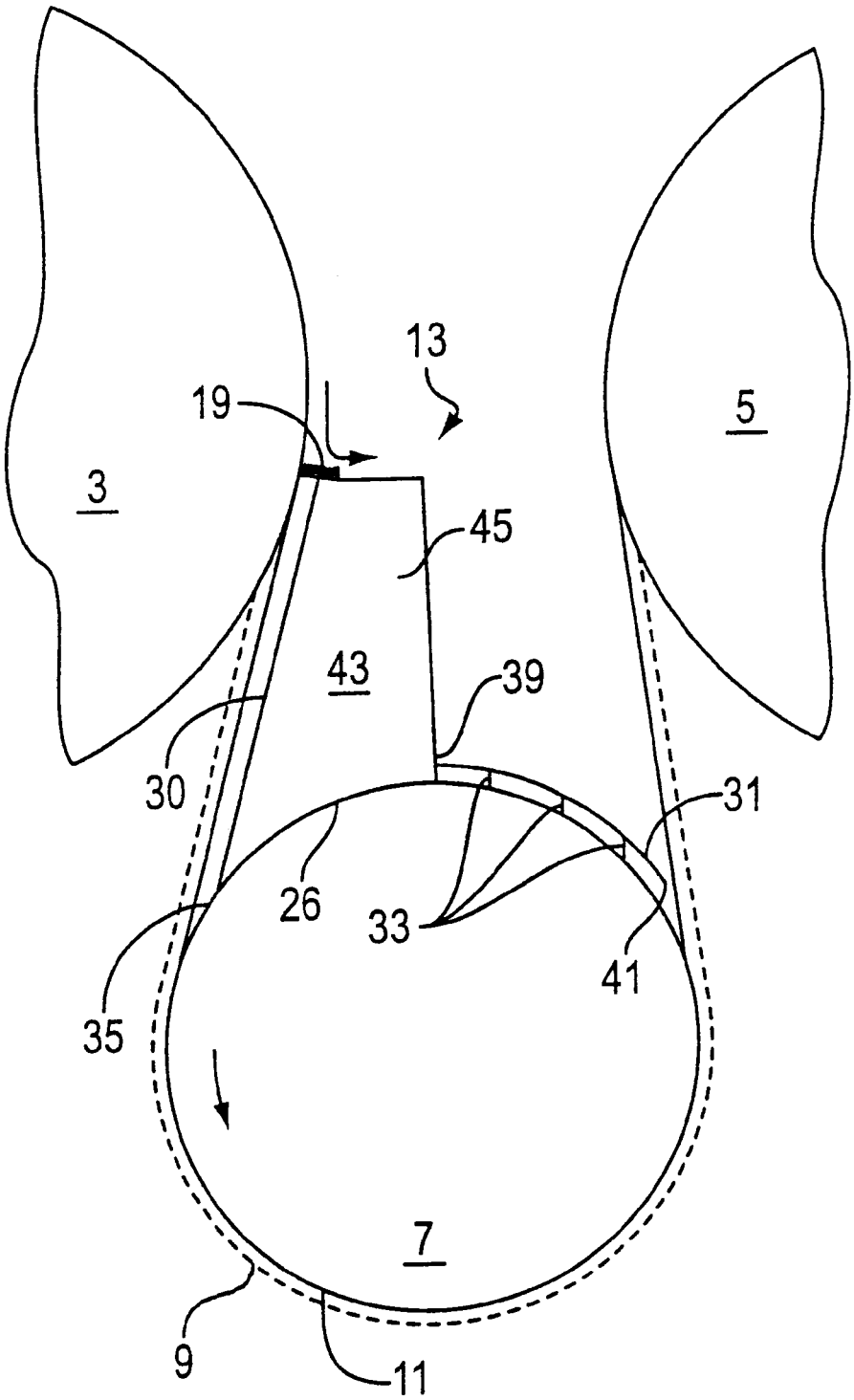
FIG. 2 is a schematic diagram of another embodiment of the air conveying device disposed in a transfer region part to be used in a machine producing a material web.

In FIG. 2, the air conveying device is a suction box 43. The suction box 43 includes a housing 45 that is connected to a vacuum source not shown here. The wall 26 of the housing 45 that is oriented toward the jacket surface 35 of the cylinder 7 is adapted to the contour of the jacket surface 35. A limit wall 30 of the suction box 43 has a number of openings arranged in a distributed fashion. The openings transmit the vacuum in the housing 45 to the conveyor belt 11 and the paper web 9. As a result, the paper web 9 and the conveyor belt 11 are stabilized as described above while passing through the transfer region.

A particularly preferred embodiment of the suction box 43 includes a wall 26, like the limit wall 30, that has openings that lead into the inside of the suction box 43. As a result, a vacuum can be exerted on the jacket surface 35 of the cylinder 7 so that an additional aspiration of the cylinder 7, which, in this particular embodiment, is a guide roll, can be eliminated.

As seen in FIG. 2, another aspect of the invention includes a cover 31, which seals the remaining free circumference region of the cylinder 7 (i.e., that area that is not covered by the suction box 43) from the surroundings of the machine. The construction and placement of the cover 31 coincides with the construction and placement of the cover described above with respect to FIG. 1. Accordingly, the cover 31 is not discussed in detail here.

As will be readily apparent to one skilled in the art, the air conveying devices of the type described in FIGS. 1 and 2, may be used in a dryer section and a press section of the machine for producing the paper web. The air conveying device is used to stabilize the web and to cover the free circumference region of the aspirated guide roll or the cylinder 7. To minimize the secondary air intake, a cover 31 is always advantageously associated with the circumference region of the cylinder 7, which is not covered by the conveyor belt, the paper web, or the air conveying device. Accordingly, the operating costs of the machine for producing the material web are reduced.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above. Various changes can be made therein without departing from the spirit and scope of the invention.

What is claimed is:

1. A machine for producing a material web, comprising:

a plurality of cylinders wherein at least one cylinder includes a free circumference region and a circumference region;

a conveyor belt for guiding the material web in a meandering path around said plurality of cylinders wherein said conveyor belt and the material web wind around said circumference region of said at least one cylinder;

at least one air conveying device disposed in a transfer region located between two of said plurality of cylinders where said conveyor belt and the material web travel in a path that is free from contact with any of said plurality of cylinders; and said at least one air conveying device comprises a wall which is adjacent said free circumference region and is at least partially contoured and adapted to at least a portion of said free circumference region, wherein said at least one air conveying device associates with said portion of said free circumference region and aspirates the material web in said transfer region.

2. The machine of claim 1, wherein the material web is a paper web.

3. The machine of claim 1, wherein the material web is a cardboard web.

4. The machine of claim 1, wherein said at least one air conveying device covers 30% to 70% of said free circumference region.

5. The machine of claim 4, wherein said at least one air conveying device further comprises a cover for covering a remaining portion of said free circumference region.

6. The machine of claim 5, wherein said cover is disposed on an outer surface of said at least one cylinder.

7. The machine of claim 5, wherein said cover is disposed on an inside of said at least one cylinder.

8. The machine of claim 5, wherein one cover is disposed on an outer surface of said at least one cylinder and another cover is disposed on an inside of said at least one cylinder.

9. The machine of claim 4, wherein said at least one air conveying device is a suction box.

10. The machine of claim 9, wherein said suction box comprises said wall being provided with through openings leading to an interior of said suction box for exerting a vacuum on a jacket surface of said at least one cylinder.

11. The machine of claim 9, wherein said suction box comprises a cover for covering a remaining portion said free circumference region of said at least one cylinder.

12. The machine of claim 4, wherein said at least one air conveying device covers 35% to 60% of said free circumference region.

13. The machine of claim 1, wherein said at least one air conveying device covers approximately 55% of said free circumference region.

14. The machine of claim 1, wherein said at least one air conveying device further comprises a multi-part housing.

15. The machine of claim 14, wherein said multi-part housing comprises a first housing part for providing a vacuum.

16. The machine of claim 14, wherein said multi-part housing further comprises a second housing part which includes said wall.

17. The machine of claim 16, wherein said multi-part housing comprises a first housing part such that said first housing part and said second housing part form a gap for withdrawing air from said transfer region.

18. The machine of claim 17, wherein said gap diverges in an air flow direction.

19. A machine for producing a material web, comprising:

a plurality of cylinders wherein at least one cylinder includes a free circumference region and a circumference region;

a transport belt for guiding the material web in a meandering path around said plurality of cylinders wherein said transport belt and the material web wind around said circumference region of said at least one cylinder;

a transfer region located between two cylinders, said transfer region being defined by a region wherein said transport belt and the material web travel in a path that is free from contact with any of said plurality of cylinders;

at least one air conveying device disposed adjacent said transfer region, and said at least one air conveying device comprises a wall which is adjacent said free circumference region and is at least partially contoured and adapted to at least a portion of said free circumference region, wherein said at least one air conveying device associates with and partially covers a portion of said free circumference region and aspirates the material web in said transfer region.

20. The machine of claim 19, wherein the material web is a paper web.

21. The machine of claim 19, wherein the material web is a cardboard web.

22. The machine of claim 19, wherein said at least one air conveying device covers 30% to 70% of said free circumference region.

23. The machine of claim 19, wherein said at least one air conveying device comprises:

a cover for covering a remaining portion of said free circumference region, said cover being disposed on an outer surface of said at least one cylinder; and a multi-part housing comprising a first housing part and a second housing part wherein said first housing part is acted upon by a vacuum.

24. The machine of claim 23, wherein said first housing part comprises:

an air blast source;

a supply line disposed inside said first housing part, wherein said air blast source is connected to said supply line; and a limit wall having at least one through opening for allowing air disposed inside of said first housing part to flow through said at least one through opening.

25. The machine of claim 23, wherein said second housing part comprises said wall which is contoured and adapted to an outer surface of said at least one cylinder, said second housing part covering a portion of said free circumference region.

26. The machine of claim 23, wherein said first housing part and said second housing part form a gap for withdrawing air from said transfer region, said gap diverging in an air flow direction.

27. A machine for producing a material web, comprising:

a plurality of cylinders wherein at least one cylinder includes a free circumference region and a circumference region;

a conveyor belt for guiding the material web in a meandering path around said plurality of cylinders wherein said conveyor belt and the material web wind around said circumference region of said at least one cylinder;

at least one air conveying device disposed in a transfer region between two of said plurality of cylinders, said transfer region being defined by a region where said conveyor belt and the material web travel in a path that is free from contact with any of said plurality of cylinders; and said at least one air conveying device further comprising a cover for covering a portion of said free circumference region which is not covered by said at least one air conveying device, said cover being adjacent said free circumference region and being at least partially contoured and adapted to an outer surface of said free circumference region, wherein said at least one air conveying device associates with said free circumference region and aspirates the material web in said transfer region.

28. The machine of claim 27, wherein said cover is adjacent said free circumference region and is at least partially contoured and adapted to an outer surface of said free circumference region.

29. The machine of claim 27, wherein said at least one air conveying device comprises:

a multi-part housing comprising a first housing part and a second housing part wherein said second housing part is acted upon by a vacuum.

30. The machine of claim 29, wherein said first housing part is a source of pressurized air.

31. The machine of claim 30, wherein said first housing part and said second housing part form a gap therebetween which allows air to be withdrawn from said transfer region.

32. A machine for producing a material web, comprising:

a plurality of cylinders wherein at least one cylinder includes a free circumference region and a circumference region;

a conveyor belt for guiding said material web in a meandering path around said plurality of cylinders wherein said conveyor belt and said material web wind around said circumference region of said at least one cylinder;

at least one air conveying device disposed in a transfer region between two of said plurality of cylinders, said transfer region being defined by a region where said conveyor belt and said material web travel in a path that is free from contact with any of said plurality of cylinders;

said at least one air conveying device comprising a cover disposed on an inside of said at least one cylinder for covering an inside portion of said free circumference region, wherein said at least one air conveying device associates with and covers 30% to 70% of said free circumference region and aspirates said material web in said transfer region.

33. A machine for producing a material web, comprising:

a plurality of cylinders wherein at least one cylinder includes a free circumference region and a circumference region;

a conveyor belt for guiding said material web in a meandering path around said plurality of cylinders wherein said conveyor belt and said material web wind around said circumference region of said at least one cylinder;

at least one air conveying device disposed in a transfer region between two of said plurality of cylinders, said transfer region being decided by a region where said conveyor belt and said material web travel in a path that is free from contact with any of said plurality of cylinders;

said at least one air conveying device comprising one cover disposed on an inside of said at least one cylinder for covering an inside portion of said free circumference region and another cover disposed on an outer surface of said at least one cylinder, wherein said at least one air conveying device associates with and covers 30% to 70% of said free circumference region and aspirates said material web in said transfer region.

34. A machine for producing a material web, comprising:

a plurality of cylinders wherein at least one cylinder includes a free circumference region and a circumference region;

a transport belt for guiding the material web in a meandering path around said plurality of cylinders wherein said transport belt and the material web wind around said circumference region of said at least one cylinder;

a transfer region located between two cylinders, said transfer region being defined by a region wherein said transport belt and the material web travel in a path that is free from contact with any of said plurality of cylinders;

at least one air conveying device disposed in said transfer region;

said at least one air conveying device comprising a cover having a contoured shape which is adapted for covering a contoured remainder portion of said free circumference region, said cover being disposed adjacent an outer surface of said at least one cylinder;

said at least one air conveying device further comprising a multi-part housing comprising a first housing part and a second housing part wherein said first housing part is acted upon by a vacuum, wherein said at least one air conveying device associates with said free circumference region and aspirates the material web in said transfer region.

35. A machine for producing a material web, comprising:

at least three cylinders;

said at least three cylinders further comprising a first, a second, and a third cylinder, wherein said first cylinder and said third cylinder are arranged along a first plane and said second cylinder is arranged along a second plane, each plane extending through a center of each cylinder and being parallel to one another;

a belt for guiding said material web from said first cylinder around a substantial portion of a circumference of said second cylinder and to said third cylinder, said belt defining a partially enclosed region between said first cylinder, said second cylinder, and said third cylinder, said partially enclosed region being further defined by a free circumference portion of said second cylinder which is not in contact with said belt;

a suction box disposed in said partially enclosed region;

said suction box comprising a first wall having an outer surface positioned adjacent a free portion of said belt, said free portion extending between said first cylinder and said second cylinder, a second wall having an outer surface positioned adjacent to and covering a portion of said free circumference portion, and a third wall;

said third wall having a cover adjacent thereto which extends adjacent to and over a substantial portion of said free circumference portion which is not covered by said second wall;

said cover having a contoured shape which substantially corresponds to a contoured shape of some portion of said free circumference portion.

36. The machine of claim 35, wherein said second roll is a guide roll.

37. The machine of claim 36, wherein said cover comprises a plurality of braces extending between said cover and an outer surface of said second cylinder.

38. The machine of claim 37, wherein said second cylinder applies a vacuum to said belt.

39. The machine of claim 36, wherein said second cylinder applies a vacuum to said belt.

40. The machine of claim 35, wherein one of said first wall and said second wall comprises a plurality of through openings.

41. A machine for producing a material web, comprising:

at least three cylinders;

said at least three cylinders further comprising a first, a second, and a third cylinder, wherein said first cylinder and said third cylinder are arranged along a first plane and said second cylinder is arranged along a second plane, each plane extending through a center of each cylinder and being parallel to one another;

a belt for guiding said material web from said first cylinder around a substantial portion of a circumference of said second cylinder and to said third cylinder, said belt defining a partially enclosed region between said first cylinder, said second cylinder, and said third cylinder, said partially enclosed region being further defined by a free circumference portion of said second cylinder which is not in contact with said belt;

a suction box disposed in said partially enclosed region;

said suction box comprising a first wall having an outer surface positioned adjacent a free portion of said belt, said free portion extending between said first cylinder and said second cylinder, a second wall having an outer surface positioned adjacent to and covering a portion of said free circumference portion, and a third wall;

said second wall having a contoured shape which substantially corresponds to a contoured shape of some portion of said free circumference portion.

* * * * *